US006123324A

United States Patent [19]

Swan et al.

[11] Patent Number: 6,123,324

[45] Date of Patent: Sep. 26, 2000

[54] PROCESS FOR HUMIDIFYING A GAS STREAM

[75] Inventors: Robert Bruce Swan, Lehighton; Diwakar Garg, Emmaus; Kerry Renard Berger, Lehighton; David Lee Mitchell, Jr., Coopersburg, all of Pa.

[73] Assignee: Air Products and Chemicals, Inc., Allentown, Pa.

[21] Appl. No.: 09/137,632

[22] Filed: Aug. 21, 1998

[51] Int. Cl.[7] ..... B01F 3/04

[52] U.S. Cl. ..... 261/128; 261/26; 261/27; 261/78.2; 261/115; 261/DIG. 34

[58] Field of Search ..... 261/26, 27, 74, 261/76, 78.2, 115, 129, 135, 128, DIG. 34

[56] References Cited

U.S. PATENT DOCUMENTS

| | | | |
|---|---|---|---|
| 942,712 | 12/1909 | Comins | 261/74 |
| 2,664,604 | 1/1954 | Hein et al. | 261/129 |
| 3,486,697 | 12/1969 | Fraser . | |
| 3,532,270 | 10/1970 | Schoen, Jr. | 261/DIG. 34 |
| 3,630,956 | 12/1971 | Benning et al. . | |
| 3,830,478 | 8/1974 | Pietroni . | |
| 3,925,109 | 12/1975 | Nilsen . | |
| 4,066,399 | 1/1978 | Gunther | 261/78.2 |
| 4,098,853 | 7/1978 | Brown et al. . | |
| 4,244,904 | 1/1981 | Drain . | |
| 4,272,014 | 6/1981 | Halfpenny et al. | 261/DIG. 34 |
| 4,317,687 | 3/1982 | Kaspersma et al. . | |
| 4,385,910 | 5/1983 | Eilers et al. . | |
| 4,425,914 | 1/1984 | Ray et al. | 261/78.2 |
| 4,541,966 | 9/1985 | Smith | 261/27 |
| 4,547,228 | 10/1985 | Girrell et al. . | |
| 4,618,462 | 10/1986 | Fisher . | |
| 4,829,763 | 5/1989 | Rao . | |
| 4,888,786 | 12/1989 | Davis et al. . | |
| 4,913,140 | 4/1990 | Orec et al. . | |
| 4,989,840 | 2/1991 | Maric . | |
| 5,004,489 | 4/1991 | Rotman et al. . | |
| 5,056,511 | 10/1991 | Ronge | 261/78.2 |
| 5,062,145 | 10/1991 | Zwaan et al. . | |
| 5,249,740 | 10/1993 | Serra Tosio et al. | 261/78.2 |
| 5,495,875 | 3/1996 | Benning et al. | 261/27 |

FOREIGN PATENT DOCUMENTS

| | | |
|---|---|---|
| 1091574 | 12/1980 | Canada . |

*Primary Examiner*—C. Scott Bushey
*Attorney, Agent, or Firm*—Willard Jones, II

[57] ABSTRACT

An improved process for humidifying a gas stream with a precise amount of moisture used in a variety of heat treating processes including annealing, brazing, and sintering of ferrous and non-ferrous metals and alloys, reflow soldering of electronic components, glass-to-metal sealing, chemical processes, chemical vapor deposition of metal oxides, laser processing, fuel cells, etc. The gaseous stream is humidified by introducing a controlled amount of water through a precision metering device and a known and precise flow rate of a gas stream into a gas-liquid contactor, and shearing and vaporizing the water stream in the gas-liquid contactor with the gas stream.

16 Claims, 2 Drawing Sheets

PROCESS FOR HUMIDIFYING A GAS STREAM

BACKGROUND OF THE INVENTION

The present invention relates to the field of producing a humidified gas stream with a precisely controlled moisture content in the gas stream.

Humidified gases such as nitrogen, non-cryogenically generated nitrogen, hydrogen, air, oxygen-enriched air, carbon dioxide, argon, helium, and mixtures thereof are widely employed by chemical, thermal, metallurgical, electronics, laser processing, fuel cells, and food processing industries to enhance chemical reactions, welding and spraying metallic and ceramic materials by thermal and plasma techniques, brazing and sintering metallic components, refining ferrous and nonferrous metals and metal alloys, enhancing combustion, providing the desired physical and mechanical properties to metals and metal alloys, soldering electronic components, depositing oxides of various elements by chemical vapor and physical vapor deposition techniques, controlling composition of gases used in lasers, manipulating composition of gases used in fuel cells, enhancing shelf life of perishable food items such as vegetables and fruits, and packaging food stuffs. They are also used in controlling the environment and adjusting comfort level for humans such as by producing and supplying synthetic breathable atmospheres and medicinal gases.

Numerous techniques have been developed and commercially used today to humidify gases. For example, a gas stream has been humidified by passing the gas stream over water placed in a vessel maintained at ambient temperature. The extent of moisture picked up by the gas stream using this technique depends upon the flow rate of the gas stream and surface area of the water exposed to the gas stream. This technique provides very limited pick up of water by the gas stream and is primarily used in applications where there is no need to control or regulate humidity of the gas stream and where the humidity requirements are not high.

To increase humidity or moisture pick up by the gas stream, a gas stream has been humidified by passing it over heated water placed in a vessel or flowing the gas stream through a screen with dripping water. Once again, the extent of moisture picked by the gas stream using this technique depends upon the flow rate of the gas stream, surface area of the water exposed to the gas stream, and water temperature. This technique is also primarily used in applications where there is no need to control or regulate humidity of the gas stream.

Numerous techniques have been employed and used to humidify gases with some type of humidity control. For example, a gas stream is split into two separate streams; one passing through the humidifier such as discussed above and the other by-passing the humidifier. The two streams are then combined and the humidity level of the combined stream is measured by a relative humidity measuring instrument. The humidity level of the combined stream is then controlled either by regulating the flow rate of the gas stream passing through the humidifier or by-passing the humidifier. Alternatively, gas streams are humidified simply by adding steam and regulating the humidity level by the extent of steam addition. Although these techniques do provide a form or type of humidity control and are suitable for many environmental control, food processing, and combustion related applications, they fail to provide the precise control of humidity that is required in many chemical, thermal, metallurgical, and electronics applications. Furthermore, they are not suitable for precisely humidifying gases with low humidity such as 2,000 ppm of moisture in the gas stream or about +8° F. or less dew point measured at ambient temperature and pressure. The main reason for failure of these techniques to provide precise control of low humidity gases is unavailability of reliable low humidity production systems and measurement devices.

Gases have been humidified with a known amount of moisture without relying on humidity measuring devices by bubbling them through water. The moisture content of the gas stream humidified by passing through a bubbler is calculated from the operating conditions such as water temperature and total pressure of the bubbler. For example, the vapor pressure of water or moisture in the gas stream is determined from the water temperature. The vapor pressure of water and total operating pressure information is then used to calculate partial pressure of water or moisture content in the gas stream. The above calculation inherently assumes that the gas stream is saturated with moisture. If the gas stream is not saturated with moisture, then the calculated moisture content value will always be higher than the real moisture content in the gas stream. This is the main reason that bubblers are seldom used in applications requiring precise, consistent and reliable humidity levels.

Numerous changes in the design of bubblers have been made over the years to provide precise, consistent and reliable humidity level in gases. These improvements have been focused toward improving gas-liquid contact and maintaining constant water level and water temperature in the bubbler. Some of the new bubbler designs do provide a humidified gas stream with precise, consistent and reliable humidity levels, provided flow rate of the gas stream is maintained constant. Therefore, bubblers are sized and designed to provide a fixed flow rate of a humidified gas stream. They, however, fail to humidify a gas stream with precise, consistent and reliable humidity level if the flow rate of the humidified gas stream changes with time or if the moisture level requirement in the humidified gas stream changes with time.

Gases such as nitrogen, argon, helium, etc. have been humidified with the precise amount of moisture by adding a known amount of oxygen or oxygen present in air and reacting the oxygen with hydrogen over a precious metal catalyst. This technique is very versatile and can be used to provide a gas stream with precise, consistent and reliable humidity level even if there is a change in flow rate of the humidified gas stream with time or change in the moisture level requirement with time. However, it requires expensive hydrogen and a precious metal catalyst to humidify gases, and is thus, prohibitively expensive. This technique is not practical to humidify gases for applications in which residual hydrogen in the humidified gas stream is not desirable and at locations where hydrogen is not available. Furthermore, this technique is not applicable to humidify gases containing oxygen such as air, oxygen-enriched air, etc.

Based on the above discussion, it is clear that there is a need for a system to humidify gases with a precise, consistent, and reliable amount of moisture without relying on a humidity measuring device. Furthermore, there is a need for a system to provide a gas stream with precise, consistent and reliable humidity level for applications requiring different flow rates of humidified gases with time and/or different humidity level with time.

SUMMARY OF THE INVENTION

This present invention pertains to an improved method and apparatus for humidifying a gas stream with a precise, consistent, and reliable amount of moisture used in a variety of heat treating processes including annealing, brazing, and sintering of ferrous and non-ferrous metals and alloys, reflow soldering of electronic components, glass-to-metal sealing, chemical processes, chemical vapor deposition of metal oxides, laser processing, fuel cells, etc. According to the process or method of the present invention, a gaseous stream is humidified by the combination of introducing a controlled amount of water through a precision metering device and a known and precise flow rate of a gas stream to a gas-liquid contactor and shearing and vaporizing the water in the gas-liquid contactor with the gas stream. The distinguishing feature of the disclosed process includes humidifying the gas stream with the precise, consistent, and reliable amount of moisture without relying on a humidity or moisture measurement device.

A method for providing a gas stream having a precise amount of humidity comprising the steps of; introducing a pre-selected amount of water into a gas-liquid contactor, the gas liquid-contactor adapted to completely vaporize the water by a gas stream introduced into the gas-liquid contactor, introducing a gas stream to be humidified into the water entering the gas-liquid contactor at a precisely controlled rate sufficient to cause the water to be vaporized by the gas stream, and withdrawing a gas stream having a precise amount of humidity from said gas-liquid contactor without requiring a device to measure moisture in the humidified gas stream.

Therefore in another aspect, the present invention is a method for humidifying a gas stream comprising the steps of; introducing a pre-selected amount of water into a top portion of an elongated vertically oriented gas-liquid contactor, introducing a gas to be humidified into said water entering said gas-liquid contactor at a rate sufficient to cause said water to be sheared and vaporized by said gas stream, permitting said vaporized water and gas to proceed through a bottom portion of said gas-liquid contactor containing an inert, non-porous packing material, and withdrawing a humidified gas stream from said bottom of said gas-liquid contactor.

In yet another aspect, the present invention is a gas-liquid contactor comprising in combination; a generally cylindrical vessel adapted to be oriented in a vertical position during use, said vessel having top and bottom portions, means to introduce a gas stream and water into said top portion of said vessel, and said means so constructed and arranged to cause said water to be sheared and vaporized by said gas stream, an inert, non-porous packing material in a bottom portion of said vessel, and withdrawal means on said bottom portion of said vessel to withdraw a gas stream from said vessel after passing through said packing material.

DETAILED DESCRIPTION OF THE INVENTION

Humidified gases such as nitrogen, non-cryogenically generated nitrogen, hydrogen, air, oxygen-enriched air, carbon dioxide, argon, helium, and mixtures thereof are widely employed by chemical, thermal, metallurgical, electronics, laser processing, fuel cells, and food processing industries to enhance chemical reactions, welding and spraying metallic and ceramic materials by thermal and plasma technique, brazing and sintering metallic components, refining ferrous and non-ferrous metals and metal alloys, enhancing combustion, providing the desired physical and mechanical properties to metals and metal alloys, soldering electronic components, depositing oxides of various elements by chemical vapor and physical vapor deposition techniques, controlling composition of gases used in producing and using lasers, manipulating composition of gases used in fuel cells, enhancing shelf life of perishable food items such as vegetables and fruits, and packaging food stuffs. These humidified gases are also used in controlling the environment and adjusting comfort levels for humans such as by producing and supplying synthetic breathable atmosphere and medicinal gases.

Gases have been humidified with a known amount of moisture without relying on humidity measuring devices by bubbling them through water. The moisture content of the gas stream humidified by passing it through a bubbler is calculated from the operating conditions such as water temperature and total pressure of the bubbler. The above calculation inherently assumes that the gas stream is saturated with the moisture. If the gas stream is not saturated with moisture, then the calculated moisture content value will always be higher than the real moisture content in the gas stream. This is the main reason that bubblers are seldom used in applications requiring precise, consistent and reliable humidity level.

According to the process of the present invention, a gaseous stream is humidified by introducing a controlled amount of water through a precision metering device such as a high performance metering pump or a liquid mass flow controller and a known and precise flow rate of a gas stream into a gas-liquid contactor and shearing and vaporizing the water stream in the gas-liquid contactor with the gas stream. A distinguishing feature of the process according to the present invention includes humidifying the gas stream with the precise, consistent, and reliable amount of moisture without relying on a humidity or moisture measurement device.

Figure 1:
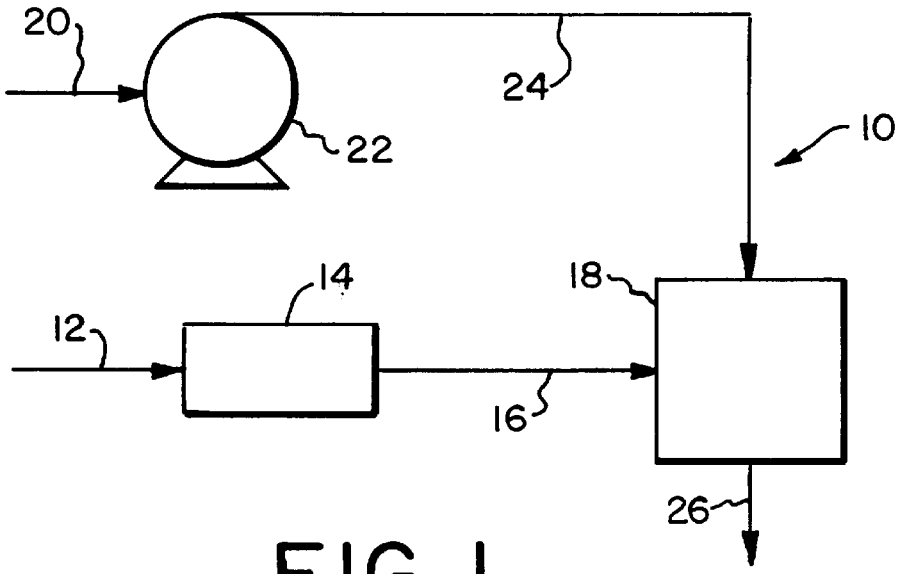
FIG. 1 is a flow diagram illustrating the process of the present invention.

A schematic drawing of the humidification process according to the present invention is shown generally as 10 in FIG. 1. A gas stream 12 is passed through a flow metering device 14, such as mass flow meter, to precisely determine flow rate of the gas stream 16. The gas stream 16 is then introduced into a gas-liquid contactor 18. Liquid water 20 is passed through a precision metering device 22 and introduced as stream 24 into gas-liquid contactor 18. The precision metering device 22 is capable of introducing the precise amount of water into the gas-liquid contactor 18. The pre-determined flow rates of liquid water and the gas stream are contacted effectively in the gas-liquid contactor 18 to completely vaporize the liquid and humidify the gas stream. The humidified gas stream 26 is then taken out of the gas-liquid contactor 18 and used in applications requiring a humidified gas stream.

Figure 2:
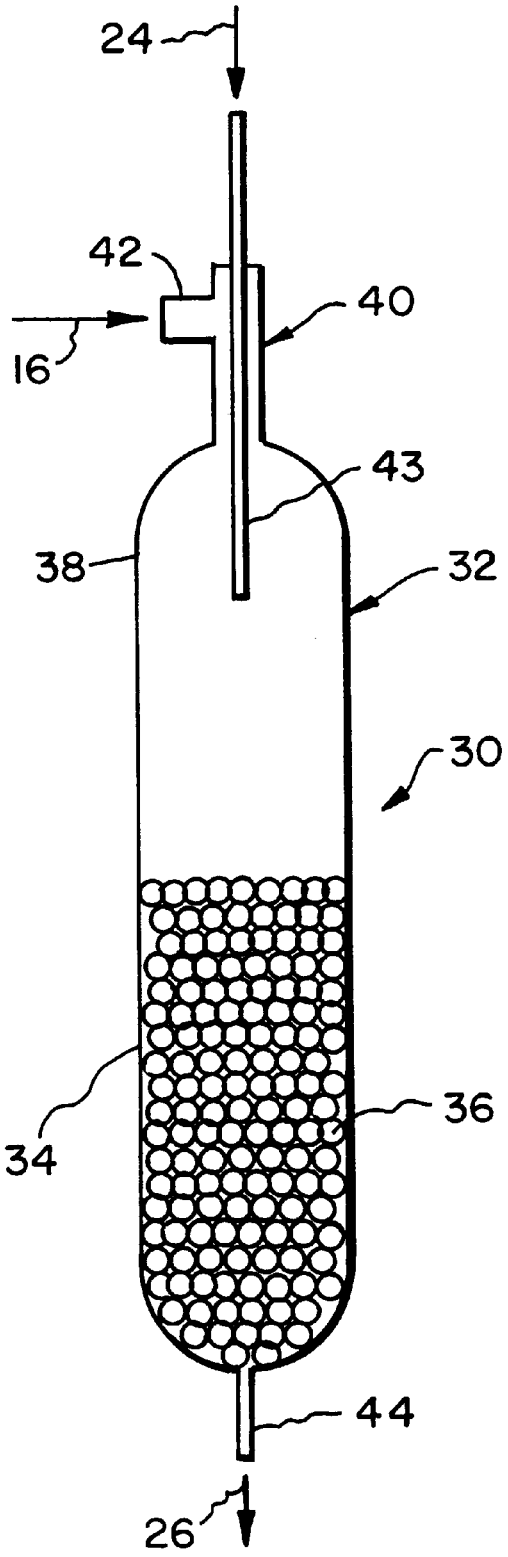
FIG. 2 is a schematic diagram of a gas-liquid contactor according to the present invention.

Any gas-liquid contactor capable of completely vaporizing liquid water with a gas stream can be used to produce humidified gas stream. However, a specially designed gas-liquid contactor 30, shown in FIG. 2, is used to humidify a gas stream in the process disclosed in the present invention. This gas liquid contactor 30 is mounted vertically, and consists of a main cylindrical vessel 32. The bottom half 34 of the main cylindrical vessel 32 of gas-liquid contactor 30 is filled with an inert, nonporous packing material 36. The top portion 38 of the main cylindrical vessel 32 or gas-liquid contactor 30 is fitted with tube 40 which is considerably smaller in diameter than the diameter of the main cylindrical vessel 32 of the gas-liquid contactor 30. The tube 40 at the top of the contactor 30 is fitted with another tube 42, preferably equal in diameter, entering tube 40 from the side, as shown in FIG. 2. This side tube 42 is used to introduce a precisely measured flow rate of a gas stream 16. The tube 40 at the top of the main cylindrical vessel 32 of the gas-liquid contactor 30 is also fitted with a fine tube 43 which is used to introduce a metered flow rate of liquid water shown by arrow 24 into the gas-liquid contactor 30. The gas 16 and liquid water 24 streams are introduced from the top and the humidified gas stream is withdrawn from the bottom of the contactor 30 through a suitable conduit 44 as a stream illustrated by arrow 26.

Figure 3:
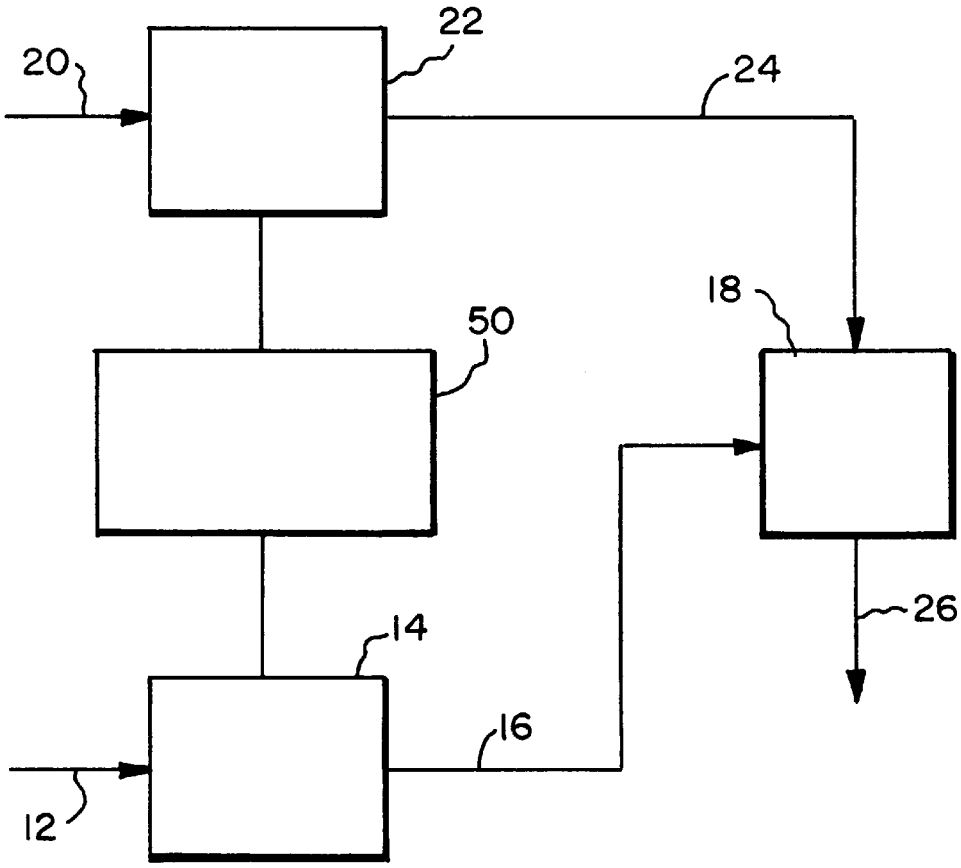
FIG. 3 is a schematic flow diagram illustrating introduction of gas and liquid streams into the process of the present invention incorporating a control device or system.

Referring to FIG. 3, a microprocessor or a PID Loop Controller 50 is used to regulate the flow rate of liquid water 20 introduced by a high performance metering device 22 into the gas-liquid contactor 18. The microprocessor 50 is programmed or loaded with the information that correlates dew point in a gas stream, measured at ambient temperature and atmospheric pressure, to the amount of moisture present in the gas stream in parts per million (ppm). This means that the microprocessor 50 can be used to provide the desired input to the high performance metering device to humidify the gas stream with the desired dew point or moisture content. The microprocessor 50 is also programmed or loaded with information that calculates the flow rate of water required to provide the desired dew point or moisture content at the desired gaseous flow rate.

Therefore, to humidify a gas stream precisely with a pre-determined but constant dew point or moisture content, the microprocessor 50 receives input signal about the gas flow rate from the mass flow meter 14 and the information about the desired dew point or moisture content from an operator. Based on this information, the microprocessor determines the flow rate of liquid water 20 needed to be supplied to provide a humidified gas stream 26 with the desired dew point or moisture content. The microprocessor 50 automatically transmits the water flow rate information to the high performance liquid metering device 22 which introduces the desired amount of water into the gas-liquid contactor 18. The microprocessor 50 continuously receives input about the gas flow rate from the mass flow meter 14, and it continuously determines and adjusts the water flow rate required to produce a humidified gas stream with the desired dew point or moisture content.

The microprocessor 50 can also be used to change the dew point or moisture content of the humidified gas stream at any time. For this operation, the operator needs to input the desired dew point or moisture content either directly on the microprocessor 50 or remotely, and the microprocessor 50 does everything else automatically. It receives input about the gas flow rate from the mass flow controller 14 and dew point or moisture content input from the operator. It calculates the flow rate of water needed to humidify the gas stream, and transmits the water flow rate information to the high performance metering device 22 to produce a humidified gas stream 26 with the desired dew point or moisture content.

Since both the flow rates of a gas stream and a liquid water stream introduced into a gas-liquid contactor are precisely known, there is no need to monitor the dew point or moisture content of the humidified gas stream or provide a feed back signal from a dew point or moisture analyzer to adjust the flow rate of either the gas stream or the water stream. This eliminates the use of a dew point or moisture analyzer that have proven to be inaccurate and unreliable in the field. However, a dew point or moisture analyzer can be incorporated into the system to periodically check the performance of the system.

A specially designed gas-liquid contactor 30 shown in FIG. 2 is used to humidify a gas stream in the process disclosed in the present invention. It is believed that the kinetic energy of the gas stream entering the contactor 30 via conduit or tube 42 from the top shears the water stream entering through a fine tube 43, thereby vaporizing most of the liquid water. The remaining water, that has not been vaporized by the shearing action of the gas stream, is vaporized by the gas stream by providing an efficient contact between the gas and liquid streams in the bottom portion 34 of the contactor 30 packed with an inert, non-porous material, or packing 36. Since the gas stream is used to vaporize the liquid stream by its kinetic energy, it is important to carefully select the diameter of the fine tube 43 for introducing water and tube 40 for introducing gas at the top of the contactor 30. The diameter of each tube is in fact selected based upon the flow rate of the humidified gas stream required for the desired application.

The fine tube 43 used for introducing liquid water can have a diameter ranging from 1/16 inch to about 1/8 inch. It is extended from about 4 inches to 12 inches into the main cylindrical vessel 32 depending upon the size of the main cylindrical vessel 32. The diameter of the fine tube 43 for introducing water can be about 1/16 inch for up to 30,000 SCFH of humidified gas stream. A fine tube 43 with a diameter larger than 1/16 inch can be used for producing more than 30,000 SCFH of humidified gas stream.

The diameter of the tube 40 at the top of the main cylindrical vessel 32 that is used to introduce the gas stream into the main cylindrical vessel 32 can vary from ½ inch to about 3 inches. Specifically, the diameter of the tube 40 at the top of the main cylindrical vessel 32 used for introducing gas can be about ½ inch for humidifying up to about 1,000 SCFH of a gas stream. It can be selected from ½ inch to about 1 inch for humidifying from about 1,000 to about 10,000 SCFH of a gas stream. Finally, a tube ranging from 1 inch to about 3 inch in diameter can be used to humidify more than 10,000 SCFH of a gas stream. The diameter of this tube is selected to provide a linear velocity of the gas stream (calculated using the flow rate of the gas stream at standard conditions) above about 40 feet/sec, preferably above about 100 feet/sec, and more preferably above about 200 feet/sec.

The diameter and length of the main cylindrical vessel 32 are selected to provide good gas-liquid contact and sufficient residence time to vaporize the liquid water that has not been vaporized by the shearing action of the gas stream. The diameter of the main cylindrical vessel 32 can vary from about 1 inch to about 10 inches. The length of the main cylindrical vessel can vary from about 1 foot to about 6 feet.

The bottom portion of the main cylindrical vessel 32 is filled with an inert, non-porous material 36 to facilitate good and efficient contact between the gas stream and the liquid water that has not been vaporized by the shearing action of the gas stream. The inert, non-porous material 36 can be glass pieces in the form of small balls, cylinders, etc. The size of the inert, non-porous packing material 36 can vary from about ¼ inch to about ½ inch depending upon the diameter of the main vessel. It is desirable to fill close to the bottom 40% of the internal volume of the main cylindrical vessel 32 with the inert, non-porous packing material 36, preferably the bottom 50% of the vessel's volume is filled with the inert, non-porous packing material, more preferably the bottom 60% of the vessel's volume is filled with the inert, non-porous packing material 36.

The gases that can be humidified according to the present invention include nitrogen, non-cryogenically generated nitrogen, hydrogen, air, oxygen-enriched air, carbon dioxide, argon, helium, xenon, krypton, and mixtures thereof.

Referring to FIG. 1, the liquid water 20 according to the present invention is introduced into the gas-liquid contactor 18 by a high performance liquid metering device 22 capable of supplying water with a precision of about 0.1% of the desired flow rate. The device 22 can be selected from a high performance liquid metering pump or a liquid mass flow controller. The device 22 is capable of supplying a precise amount of water at high pressure, such as up to about 50 psig, and up to about 500 psig pressure, preferably up to about 2,000 psig pressure, more preferably up to about 6,000 psig pressure. It is important to carefully monitor and control the quality of the water used for humidifying gases. The water should be free from insoluble inorganic materials, and should contain very low levels of dissolved impurities. It is, however, preferred to use purified water such as de-ionized water, distilled water, or de-ionized and distilled water.

The process according to the present invention is suitable for humidifying gases without applying any heat to the gaseous stream. It is most suitable for humidifying gases that are at ambient temperatures such as between 60 and 100° F. If the gas stream to be humidified is available at a temperature of 40° F. or below, it is desirable to pre-heat the gas stream to a temperature close to 60° F. prior to humidifying it.

The process according to the present invention is most suitable for humidifying gases with equal to or less than 2,000 ppm (parts per million) moisture or about +8° F. dew point measured at ambient temperature and pressure. Preferably, the process of the invention is suitable for humidifying gases with equal to or less than 1,000 ppm (parts per million) moisture or about −5° F. dew point measured at ambient temperature and pressure. More preferably, the process is suitable for humidifying gases with equal to or less than 500 ppm (parts per million) moisture or about −16° F. dew point measured at ambient temperature and pressure. Most preferably, the process is suitable for humidifying gases with equal to or less than 215 ppm (parts per million) moisture or about −31° F. dew point measured at ambient temperature and pressure. It is possible to humidify the gas stream with more than 2,000 ppm moisture, but it results in cooling the gaseous stream due to latent heat of vaporization of liquid water and increases chances of condensing water either in the bottom portion of the gas-liquid contactor or in the downstream piping. It is, therefore, desirable to avoid humidifying a gaseous stream with more than 2,000 ppm of moisture. The problem with water condensation can, however, be avoided by providing heat from an external source either to the gaseous feed stream 12 or the gas-liquid contactor 18.

The process according to the present invention can be used to humidify a gas stream under pressure or slightly above atmospheric pressure. A slightly above atmospheric pressure is required to ensure continuous flow of the gas stream to be humidified. Specifically, a gas stream can be humidified and supplied at pressure ranging from slightly above atmospheric pressure to close to about 4,000 psig pressure.

The following examples further illustrate the present invention.

EXAMPLE 1

A gas-liquid contactor 30 similar to the one shown in FIG. 2 was designed and built from an one-inch diameter and 24 inch long pipe. The gas-liquid contactor 30 was fitted with an one-inch diameter tee 40 at the top to introduce a gas stream from the side. Therefore, the diameter of the pipe to introduce the gas stream and that of the main vessel were same in this gas-liquid contactor 30. A 1/16 inch diameter fine tube 43 was fitted into the tee 40 with a reducing fitting from the top of the gas-liquid contactor 30 to introduce water. This fine tube 43 extended about 6 inches into the main vessel 32. The bottom 10 inches of the main vessel was filled with a non-porous inert packing material 36 being glass balls of ~0.25 inch in diameter. A ¾ inch diameter tube 44 was fitted at the bottom of the main vessel 32 to withdraw a humidified gas stream from the vessel 30.

A gaseous stream consisting of primarily pure nitrogen at 500 SCFH was introduced into the gas-liquid contactor. The gas stream was supplied at ambient temperature or close to 70° F. The linear velocity of the gas through gas inlet pipe 42 was ~26 ft/sec which is considerably below the minimum of 40 ft/sec required to effectively shear the liquid stream. The contactor was operated at about 62 psig pressure. A fine metering pump, Model # QG50-0 was used to pump 0.041 cc/min of distilled water into the gas-liquid contactor. The pump was supplied by Fluid Metering, Inc. of Oyster Bay, N.Y. The flow rate of water was calculated to provide close to 215 ppm of moisture in the gas stream or about −31° F. dew point in the humidified gas stream, measured at ambient temperature and pressure.

A sample of the humidified gas (nitrogen) stream was withdrawn and analyzed for moisture content by a Humidity Data Processor or dew point analyzer supplied by Viasala of Helsinki, Finland. The dew point was measured to be approximately −34° F., but it was not steady. The dew point analyzer periodically showed spikes of very high dew point, indicating improper humidification of the gas stream. This poor humidification was probably related to the use of insufficient gas velocity to shear and vaporize the liquid stream.

This example, therefore, showed that a gas stream can not be effectively humidified in the gas-liquid contactor of the present invention if the liquid stream is not effectively sheared and vaporized by the gas stream.

EXAMPLE 2

The humidification of the gas stream experiment described in Example was repeated using the same gas-liquid contactor and fine metering pump for introducing water into the gas-liquid contactor with the exception of introducing 1,000 SCFH of nitrogen and 0.082 cc/min of distilled water into the gas-liquid contactor. The linear velocity of the gas introduced through gas inlet pipe was ~52 ft/sec which is above the minimum value required to effectively shear the liquid stream. The contactor was operated at about 56 psig pressure. The flow rate of water was calculated to provide close to 215 ppm of moisture in the gas stream or about −31° F. dew point in the gas stream, measured at ambient temperature and pressure.

Sample of the humidified gas (nitrogen) stream that was withdrawn for moisture analysis showed close to −32° F. dew point. Additionally, the moisture content did not change with time, indicating proper humidification of the gas stream.

This example, therefore, showed that a gas stream can be effectively humidified in the gas-liquid contactor of the present invention provided the liquid stream is effectively sheared and vaporized by the gas stream.

EXAMPLE 3

The humidification of the gas stream experiment described in Example 1 was repeated using the same gas-liquid contactor and fine metering pump for introducing water into the gas-liquid contactor with the exception of introducing 2,000 SCFH of nitrogen and 0.166 cc/min of distilled water into the gas-liquid contactor. The linear velocity of the gas introduced through gas inlet pipe was ~103 ft/sec which is above the minimum value required to effectively shear the liquid stream. The contactor was operated at about 58 psig pressure. The flow rate of water was calculated to provide close to 215 ppm of moisture in the gas stream or about −31° F. dew point in the gas stream measured, at ambient temperature and pressure.

A sample of the humidified gas (nitrogen) stream was withdrawn and analyzed for moisture content by an Optical Dewpoint Sensor supplied by General Eastern of Woburn, Mass. This moisture analyzer is believed to be more accurate than the one supplied by Viasala. The moisture content of the humidified gas stream was measured to be close to −32° F. dew point. Additionally, the moisture content varied within a very narrow range of −32.0 to −z32.5° F.

This example, therefore, showed that a gas stream can be effectively humidified in the gas-liquid contactor of the present invention provided the liquid stream is effectively sheared and vaporized by the gas stream.

EXAMPLE 4

A gas-liquid contactor similar to the one shown in FIG. 2 was designed and built from a three-inch diameter and 19 inch long pipe. The ends of the three-inch diameter pipe, which formed the main vessel, were fitted with three-inch long reducing caps, one at the top and the other at the bottom, that reduced the diameter of the pipe from three inches to one inch. The gas-liquid contactor was fitted with an one-inch diameter tee at the top to introduce a gas stream from the side. A 1/16 inch diameter fine tube was fitted into the tee with a reducing fitting from the top to introduce water. This fine tube extended about 7 inches into the main vessel. The bottom 9 inches of the main vessel was filled with glass rods that were ½ inch in diameter and ½ inch long. The reducing cap fitted at the bottom of the main vessel was fitted with another reducing fitting to reduce the diameter from 1 in. to ¾ inch. A ¾ inch diameter tube was fitted at the bottom of the main vessel to withdraw humidified gas from the vessel.

A gaseous stream consisting of primarily pure nitrogen at 1,000 SCFH was introduced into the gas-liquid contactor. The gas stream was supplied at ambient temperature or close to 70° F. The linear velocity of the gas through gas inlet pipe was ~52 ft/sec which is above the minimum value required to effectively shear the liquid stream. The contactor was operated at about 60 psig pressure. A fine metering pump, Model # 2350 HPLC Pump was used to pump ~0.17 cc/min of distilled water into the gas-liquid contactor. The pump was supplied by ISCO, Inc. of Lincoln, Nebr. The flow rate of water was calculated to provide close to 450 ppm of moisture in the gas stream or about −18° F. dew point in the gas stream, measured at ambient temperature and pressure.

A sample of the humidified gas (nitrogen) stream was withdrawn and analyzed for moisture content by an Optical Dewpoint Sensor. The moisture content of the humidified gas stream was measured to be close to −17.1° F. dew point. Additionally, the moisture content varied within a very narrow range of −17.1 to −17.5° F. dew point.

This example, therefore, showed that a gas stream can be effectively humidified in the gas-liquid contactor of the present invention provided the liquid stream is effectively sheared and vaporized by the gas stream.

EXAMPLE 5

The humidification of a gas stream experiment described in Example 4 was repeated four times using the same gas-liquid contactor and fine metering pump for introducing distilled water into the gas-liquid contactor with the exception of introducing 2,000 SCFH of nitrogen. The water pump rate was varied in these experiments from 0.166, 0.332, 0.50, and 0.85 cc/min to provide close to 215, 450, 660, and 1,120 ppm moisture or about −31, −18, −13, and −2° F. dew point, respectively. The linear velocity of the gas introduced through gas inlet pipe was ~103 ft/sec which is above the minimum of 40 ft/sec required to effectively shear the liquid stream. The contactor was operated at about 60 psig pressure.

Samples of the humidified gas (nitrogen) stream from these experiments revealed the presence of −30.5, −18.2, −12.2, and −1.2° F. dew point, measured at ambient temperature and pressure. The measured dew points in these experiments varied by less than 1° F. from the calculated values.

This example, therefore, showed that a gas stream can be effectively humidified in the gas-liquid contactor of the present invention provided the liquid stream is effectively sheared and vaporized by the gas stream.

EXAMPLE 6

The humidification of a gas stream experiment described in Example 4 was repeated two times using the same gas-liquid contactor and fine metering pump for introducing distilled water into the gas-liquid contactor with the exception of introducing 4,000 SCFH of nitrogen. The water pump rate used in these experiments was 0.332 and 0.664 cc/min to provide close to 215 and 450 ppm moisture or about 31 and −18° F. dew point, respectively. The linear velocity of the gas introduced through gas inlet pipe was ~206 ft/sec which is above the minimum of 40 ft/sec. required to effectively shear the liquid stream. The contactor was operated at about 60 psig pressure.

Samples of the humidified gas (nitrogen) stream from these experiments revealed the presence of −30.2 and −18.2° F. dew point, measured at ambient temperature and pressure. The measured dew points in these experiments varied by less than 1° F. from the calculated values.

This example, therefore, showed that a gas stream can be effectively humidified in the gas-liquid contactor of the present invention provided the liquid stream is effectively sheared and vaporized by the gas stream.

EXAMPLE 7

The humidification of a gas stream experiment described in Example 4 was repeated using the same gas-liquid contactor and fine metering pump for introducing water into the gas-liquid contactor with the exception of introducing 6,000 SCFH of nitrogen and 0.50 cc/min of distilled water to provide close to 215 ppm moisture or about −31° F. dew point. The linear velocity of the gas introduced through gas inlet pipe was ~307 ft/sec which is above the minimum of 40 ft/sec required to effectively shear the liquid stream. The contactor was operated at about 60 psig pressure.

Sample of the humidified gas (nitrogen) stream from this experiment revealed the presence of −30.8° F. dew point, measured at ambient temperature and pressure. The measured dew point in this experiment varied by less than 1° F. from the calculated value.

This example, therefore, showed that a gas stream can be effectively humidified in the gas-liquid contactor of the present invention provided the liquid stream is effectively sheared and vaporized by the gas stream.

EXAMPLE 8

The humidification of a gas stream experiment described in Example 4 was repeated three times using the same gas-liquid contactor and fine metering pump for introducing distilled water into the gas-liquid contactor with the exception of introducing 8,000 SCFH of nitrogen. The water pump rate used in these experiments was 0.664, 1.34, and 2.0 cc/min to provide close to 215, 450, and 660 ppm moisture or about −31 −18, and −13° F. dew point, respectively. The linear velocity of the gas introduced through gas inlet pipe was ~412 ft/sec which is above the minimum of 40 ft/sec required to effectively shear the liquid stream. The contactor was operated at about 60 psig pressure.

Samples of the humidified gas (nitrogen) stream from these experiments revealed the presence of −30.8, −18.2, and −12° F. dew point measured, at ambient temperature and pressure. The measured dew points in these experiments varied by 1° F. from the calculated values.

This example, therefore, showed that a gas stream can be effectively humidified in the gas-liquid contactor of the present invention provided the liquid stream is effectively sheared and vaporized by the gas stream.

EXAMPLE 9

A gas-liquid contactor similar to the one shown in FIG. 2 was designed and built from a six-inch diameter and 40 inch long pipe. The ends of the six-inch diameter pipe, which formed the main vessel, were fitted with reducing caps that reduced the diameter of the pipe from six inches to two inches. The gas-liquid contactor was fitted with a two-inch diameter tee at the top to introduce a gas stream from the side. A 1/16 inch diameter fine tube was fitted into the tee with a reducing fitting from the top to introduce water. This fine tube extended about 12 inches into the main vessel. The bottom 18 inches of the main vessel was filled with glass rods that were ½ inch in diameter and ½ inch long. The reducing cap at the bottom of the main vessel was fitted with a two-inch diameter tube to withdraw humidified gas from the vessel. The gas-liquid contactor was fully integrated into a system with a distillation unit to provide distilled water for humidification and a constaMetric 3200 Series HPLC pump supplied by Thermo Separation Products of Riviera Beach, Fla. The system was also integrated with a microprocessor to receive input from the mass flow meter for the gas flow rate and transmit signal to the pump based on the desired moisture content or dew point.

A gaseous stream consisting of primarily pure nitrogen at 6,000 SCFH was introduced into the gas-liquid contactor. The gas stream was supplied at ambient temperature or close to 70° F. The linear velocity of the gas through gas inlet pipe was ~77 ft/sec which is above the minimum value required to effectively shear the liquid stream. The contactor was operated at about 60 psig pressure. The microprocessor was given an input to provide humidified nitrogen with 700 ppm of moisture or about −11° F. dew point measured at ambient temperature and pressure. The microprocessor calculated the required flow rate of water and provided the necessary input to the pump.

A sample of the humidified gas (nitrogen) stream was withdrawn and analyzed for moisture content by an Optical Dewpoint Sensor. Within a short period of time the system was observed to produce a humidified nitrogen stream with −11° F. dew point moisture with less than 1° F. variation in the dew point. The system was operated for a number of hours without noticing any degradation in its performance.

This example, therefore, showed that an automatic system can be designed and built to effectively humidified the gas stream with a precise, consistent, and reliable amount of moisture without relying on a humidity measuring device by using the gas-liquid contactor of the present invention.

EXAMPLE 10

The performance of the humidification system described in Example 9 was tested by flowing 13,000 SCFH of air. The air was supplied at ambient temperature or close to 70° F. The linear velocity of the air through gas inlet pipe was ~167 ft/sec. which is above the minimum value required to effectively shear the liquid stream. The gas-liquid contactor of the system was operated at about 60 psig pressure. The microprocessor was given an input to provide humidified nitrogen with 215 ppm of moisture or −31° F. dew point measured at ambient temperature and pressure. The microprocessor calculated the required flow rate of water and provided the necessary input to the pump.

A sample of the humidified gas (nitrogen) stream was withdrawn and analyzed for moisture content by an Optical Dewpoint Sensor. Within a short period of time the system was observed to produce a humidified nitrogen stream with −31° F. dew point moisture with less than 1° F. variation in the dew point. The system was operated for one hour without noticing any degradation in its performance. Thereafter, the flow rate of air was reduced to 8,000 without changing humidity input to the microprocessor. The microprocessor automatically calculated the desired pump rate and provided the necessary input to the pump. The dew point of the humidified nitrogen stream was monitored continuously. It was found not to change by more than 1° F. dew point even after reducing the flow rate of air from 13,000 to 8,000 SCFH. The system was operated for another hour without noticing any degradation in its performance. Thereafter, the flow rate of air was increased to 13,000 SCFH without changing humidity input to the microprocessor. Once again, the microprocessor automatically calculated the desired pump rate and provided the necessary input to the pump. The dew point of the humidified nitrogen stream was monitored continuously. It was found not to change by more than 1° F. dew point even after increasing the flow rate of air from 8,000 to 13,000 SCFH. The flow rate of air was reduced to 8,000 SCFH after one hour and then increase to 13,000 SCFH after another hour. The moisture content or dew point of the humidified air stream remained within 1° F. of the desired value.

This example, therefore, showed that the process according to the present invention can effectively humidified a gas stream with a precise, consistent, and reliable amount of moisture without relying on a humidity measuring device.

Although the present invention is described to humidify a gas stream with water, it can be used to introduce a precise amount of a vaporizable organic compound or chemical or a hydrocarbon liquid into a gas stream.

Having thus described our invention what is desired to be secured by letters patent of the United States, without limitations, is set forth in the appended claims.

What is claimed is:

1. A method for providing a gas stream having a precise amount of humidity comprising the steps of:

introducing a pre-selected amount of water into a gas-liquid contactor, said gas-liquid contactor adapted to completely vaporize said water by a gas stream introduced into said gas-liquid contactor;

introducing a gas stream to be humidified into said water entering said gas-liquid contactor at a precisely controlled rate sufficient to cause said water to be vaporized by said gas stream; and withdrawing a gas stream having a precise amount of humidity from said gas-liquid contactor without requiring a device to measure moisture in said humidified gas stream.

2. A method according to claim 1 wherein said gas is introduced into said gas-liquid contactor at a pressure slightly above atmospheric pressure.

3. A method according to claim 1 wherein said gas is introduced into said gas-liquid contactor at a pressure of about 100 psig.

4. A method according to claim 1 wherein said gas is introduced into said gas-liquid contactor at a pressure below about 4000 psig.

5. A method according to claim 1 wherein said water is introduced into said contactor at a pressure of between 50 psig and 6000 psig.

6. A method according to claim 1 including constructing said gas-liquid contactor to permit a user to introduce said gas into said gas-liquid contactor at a flow rate between about 1000 to greater than 10,000 standard cubic feet per hour.

7. A method according to claim 1 including preheating said gas stream to a temperature above about 60° F. prior to introducing said gas stream into said gas-liquid contactor.

8. A method according to claim 7 wherein said gas stream is at a temperature of between about 60° F. and 100° F.

9. A method according to claim 1 withdrawing a humidified gas stream having less than about 2,000 parts per million moisture.

10. A method according to claim 9 including withdrawing a gas stream having a moisture content of less than 1000 ppm.

11. A method according to claim 9, including withdrawing a gas stream having a moisture content of less than 500 ppm.

12. A method according to claim 9 including withdrawing a gas steam having a moisture content of less than 215 ppm.

13. A method according to claim 1 including constructing said gas-liquid contactor so that said gas can be introduced into said gas-liquid contactor at a velocity above about 40 ft./sec.

14. A method according to claim 13 including constructing said gas-liquid contactor so that said gas can be introduced into said gas-liquid contactor at a velocity above about 100 feet/sec.

15. A method according to claim 13 including constructing said gas-liquid contactor so that said gas can be introduced into said gas-liquid contactor at a velocity above about 200 feet/sec.

16. A method for producing a humidified gas stream having less than about 2000 parts per million moisture comprising the steps of:

introducing a pre-selected amount of water into a gas-liquid contactor, said gas-liquid contactor adapted to completely vaporize said water by a gas stream introduced into said gas-liquid contactor;

introducing a gas stream to be humidified into said gas-liquid contactor at a velocity at or above 40 ft./sec, said gas stream being at or above 60° F.; and withdrawing a gas stream having less than about 2000 parts per million moisture from said gas-liquid contactor.

* * * * *